US009344824B2

(12) United States Patent
Meier

(10) Patent No.: US 9,344,824 B2
(45) Date of Patent: May 17, 2016

(54) METHOD AND APPARATUS FOR CONVERSION OF A MULTI-CHANNEL AUDIO SIGNAL INTO A TWO-CHANNEL AUDIO SIGNAL

(71) Applicant: INSTITUT FUR RUNDFUNKTECHNIK GMBH, Munich (DE)

(72) Inventor: Michael Meier, Munich (DE)

(73) Assignee: Institut Fur Rundfunktechnik GMBH, Munich (DE)

( * ) Notice: Subject to any disclaimer, the term of this patent is extended or adjusted under 35 U.S.C. 154(b) by 30 days.

(21) Appl. No.: 14/374,172

(22) PCT Filed: Jan. 22, 2013

(86) PCT No.: PCT/EP2013/051104

§ 371 (c)(1),
(2) Date: Jul. 23, 2014

(87) PCT Pub. No.: WO2013/110589

PCT Pub. Date: Aug. 1, 2013

(65) Prior Publication Data

US 2015/0036829 A1 Feb. 5, 2015

(30) Foreign Application Priority Data

Jan. 26, 2012 (IT) ..... TO2012A0067

(51) Int. Cl.
*H04R 5/00* (2006.01)
*H04R 5/02* (2006.01)
(Continued)

(52) U.S. Cl.
CPC . *H04S 3/00* (2013.01); *H04S 3/002* (2013.01); *H04S 5/00* (2013.01); *H04S 5/005* (2013.01); *H04S 2400/01* (2013.01)

(58) Field of Classification Search
CPC ..... H04S 2400/01; H04S 3/00; H04S 3/002; H04S 5/00; H04S 5/005; H04S 5/02
USPC ..... 381/17, 18, 19, 307
See application file for complete search history.

(56) References Cited

U.S. PATENT DOCUMENTS 5,857,026 A 1/1999 Scheiber
6,052,470 A * 4/2000 Mouri ..... H04S 1/002 381/1

(Continued)

FOREIGN PATENT DOCUMENTS

TW 313857 8/2009
WO 02/41668 A2 5/2002

(Continued)

OTHER PUBLICATIONS

International Search Report dated Feb. 22, 2013, issued in PCT Application No. PCT/EP2013/051104, filed Jan. 22, 2013.

(Continued)

*Primary Examiner* — Khai N Nguyen
(74) *Attorney, Agent, or Firm* — Workman Nydegger

(57) ABSTRACT

A method for conversion of a n-channel audio signal (L, R, Ls, Rs) into a two-channel audio signal (Ro, Lo), where n≥4 and integer, includes the step of generating either one of the two-channel audio signals, right (Ro) or left (Lo), by a combination of: a front (R, L) and rear (Rs, Ls) signal components of the n-channel audio signal of the same side (right or left), and a front (L, R) signal component of the n-channel audio signal of the other side (left or right), and a term dependent of n.

16 Claims, 5 Drawing Sheets

(51) Int. Cl.
*H04S 3/00* (2006.01)
*H04S 5/00* (2006.01)

(56) References Cited

U.S. PATENT DOCUMENTS 6,493,674 B1 * 12/2002 Takamizawa ..... G10L 19/0212 704/501
7,680,290 B2 * 3/2010 Ko ..... H04S 3/002 381/17
8,442,237 B2 * 5/2013 Kim ..... H04S 3/02 381/1
2005/0053249 A1 3/2005 Wu et al.
2006/0009225 A1 1/2006 Herre et al.
2006/0013419 A1 * 1/2006 Ko ..... H04S 3/002 381/310
2006/0115100 A1 6/2006 Faller
2007/0133831 A1 * 6/2007 Kim ..... H04S 3/02 381/313
2007/0258607 A1 11/2007 Purnhagen et al.
2009/0060204 A1 * 3/2009 Reams ..... H04S 3/00 381/1
2009/0080666 A1 3/2009 Uhle et al.
2011/0255714 A1 * 10/2011 Neusinger ..... G10L 19/008 381/119

FOREIGN PATENT DOCUMENTS

WO 2005/101371 A1 10/2005
WO 2006/048227 A1 5/2006
WO 2006/054270 A1 5/2006
WO 2010/125104 A1 11/2010
WO 2011/057922 A1 5/2011
WO 2011/072729 A1 6/2011

OTHER PUBLICATIONS

Written Opinion dated Feb. 22, 2013, issued in PCT Application No. PCT/EP2013/051104, filed Jan. 22, 2013.

* cited by examiner

METHOD AND APPARATUS FOR CONVERSION OF A MULTI-CHANNEL AUDIO SIGNAL INTO A TWO-CHANNEL AUDIO SIGNAL

FIELD OF THE INVENTION

The present invention relates to a method and apparatus for conversion of a multi-channel audio signal into a two-channel audio signal.

DESCRIPTION OF THE PRIOR ART

Techniques for conversion of multi-channel audio signals into two-channel signals are known, and normally referred to as down-mixing techniques.

With down-mixing it is possible to reproduce an original multi-channel audio signal by a normal stereo equipment with two channels and two loudspeaker cabinets. Anyway the known down-mixing techniques do not allow the listener to recognize the physical origin of the sound, that is normally achieved by reproducing the original multi-channel signal with a multi-channel reproduction system.

An example of a well-known multi-channel audio signal is the so-called surround sound system. Channel surround representation includes, in addition to the two front stereo channels L and R, an additional front center channel C and two surround rear channels Ls, Rs. In the recording phase a physical disposition of microphones is for example as shown in FIG. 1. Five microphones mL, mR, mC, mLs and mRs are positioned in a recording studio. The microphones generate the surround audio signals L, R, C, Ls and Rs, as respectively indicated above. Those surround signals are supplied during reproduction to corresponding loudspeakers located in a listening room, for example as shown in FIG. 2.

As known, the down-mixing of the original surround signals (L, R, C, Ls, Rs) into a stereo signal (L',R') is made by performing a linear combination of the original signals as for example given by the following formulae:

$$L'=L+\alpha\cdot C+\beta\cdot Ls$$

$$R'=R+\alpha\cdot C+\beta\cdot Rs$$

where $\alpha$ and $\beta$ are constants, e.g. both equal to 0.5. Each of the two stereo signals L', R' is given by a linear combination of the front and rear signals of the same side, and of the center channel C.

The L' and R' signals are supplied to the left and right loudspeaker of a stereo loudspeaker arrangement for reproduction to a listener, see FIG. 3. In this way, a listener positioned at position P1 perceives a (pseudo) surround sensation even if the surround signal is reproduced in down-mixed form by the two loudspeakers L and R.

Let us now assume a situation in which for example a five-channel recording is made of a sound originated from two speaking persons, the one (S1) standing at a location close to the mLs microphone, and the other (S2) standing at a location close to the mL microphone, as shown in FIG. 1. These sounds have a level such that the two right-side microphones mR, mRs do not perceive valuable contributions.

Upon reproduction of this recording via a stereo loudspeaker arrangement and after down-mixing according to the known technique described above, all the audio signals from the mLs and mL microphones are reproduced by the left loudspeaker L and no correct (separate) localization of the two speaking persons is possible. Namely, the sound signals produced by both speaking persons located at the mLs microphone and the mL microphone are now reproduced by the left loudspeaker L and the listener perceives both persons as being located at the location of the left loudspeaker.

By this specific example, it is shown that there is a number of situations in which the down-mixed audio signal does not allow a listener to differentiate between positions of speaking persons and therefore does not allow to maintain the relative virtual positions between sound sources with respect to their original position. This applies more specifically in situations in which in the generation/recording phase the sound sources are located close to the front and rear pick-up means of one side only. Another problematic situation may occur in case a speaking person walks from one microphone position to another. The movement can not be perceived in known down-mixing systems.

SUMMARY OF THE INVENTION

Therefore it is the main object of the present invention to provide a method and apparatus for conversion of a multi-channel audio signal into a two-channel audio signal which overcomes the above problems.

An object of the present invention is, according to claim 1, a method for conversion of a n-channel audio signal (L, R, Ls, Rs) into a two-channel audio signal (Ro, Lo), where $n \geq 4$ and integer, comprising the step of generating either one of the two-channel audio signals, right (Ro) or left (Lo), by a combination of:

- a front (R, L) and rear (Ls, Rs) signal components of the n-channel audio signal of the same side (right or left), and
- a front (L, R) signal component of the n-channel audio signal of the other side (left or right), and
- a term dependent of n.

Preferably in the method, in the combination said front (L, R) signal component of the n-channel audio signal of the other side is multiplied by a factor $\delta<1$, preferably in the range [0, 0.5], more preferably =0.25.

Preferably in the method, the other one of the two-channel audio signals, right (Ro) or left (Lo), is generated by a combination of:

- the front (R, L) and rear (Ls, Rs) signal components of the n-channel audio signal of the same side (left or right), said front (R, L) signal component being multiplied by a factor $(1-\delta)$, and
- said term dependent of n.

A further object of the present invention is an apparatus configured so as to implement the above method.

These and further objects are achieved by means of an apparatus and method for conversion of a multi-channel audio signal into a two-channel audio signal, as described in the attached claims, which form an integral part of the present description.

BRIEF DESCRIPTION OF THE DRAWINGS

The invention will become fully clear from the following detailed description, given by way of a mere exemplifying and non limiting example, to be read with reference to the attached drawing figures, wherein.

The same reference numerals and letters in the figures designate the same or functionally equivalent parts.

DETAILED DESCRIPTION OF THE PREFERRED EMBODIMENTS

In the following some specific non limiting examples of embodiment of the method of the present invention will be described.

Figure 1:
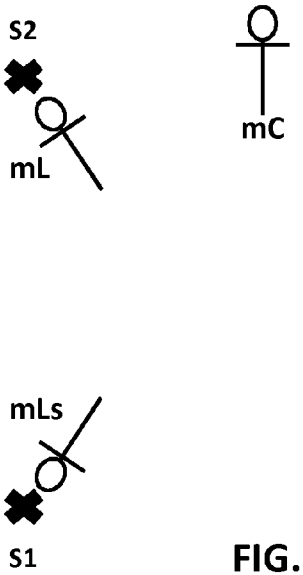
FIG. 1 shows an example of disposition of five microphones for recording a surround sound signal.
Figure 2:
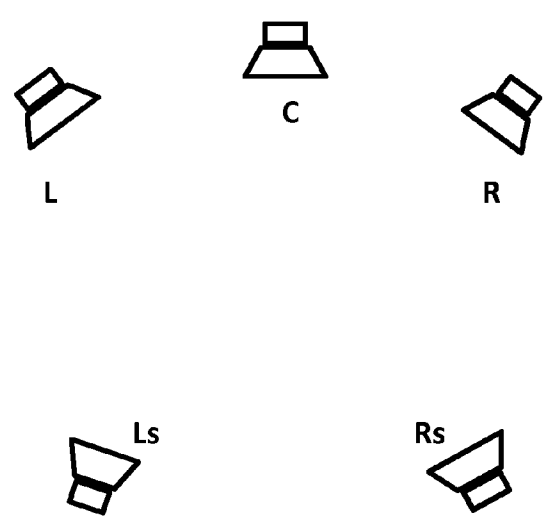
FIG. 2 shows an example of disposition of five loudspeakers for reproduction of a surround sound signal.

A first embodiment of the invention applies primarily in a situation like the one described above, with reference to FIGS. 1 and 2, where: L, R, C, Ls and Rs are respectively front left, front right, center, back left and back right components of the multi-channel audio signal, already mentioned above. In this case we have an input multi-channel audio signal with n=5 input channels.

It is worth noticing that generally the input signals don't necessarily need to be microphone signals. They could be provided by any device capable of generating multichannel (surround) signals, e.g. mixing consoles, computer/artificially generated content (room simulation tools etc.), generic playback devices and so on.

According to the invention, the following formulae for the down-mixing process apply, in which one of the two stereo signals, for example Ro, is modified:

$$Lo=L+\alpha\cdot C+\beta\cdot Ls$$

$$Ro=R+\alpha\cdot C+\beta\cdot Rs+\delta\cdot L$$

where Lo, Ro, are the left and right components of the down-mixed audio signal; $\alpha$ and $\beta$ are constants like those described above, $\delta$ is a constant, preferably substantially smaller than 0.5.

A possible range for $\alpha$ and $\beta$ would be [0, 1], while −3 dB=0.707945 . . . is preferred.

A possible range for $\delta$ would be [0, 0.5], while 0.25 is preferred.

Preferably, the Lo signal is also modified in the following way:

$$Lo=\eta\cdot L+\alpha\cdot C+\beta\cdot Ls$$

Where preferably $\eta\leq 1$, more preferably $\eta=(1-\delta)$.

$\eta$ is introduced here to approximate the global level of the sound generated by the down-mix signals to the global level of the multi-channel surround signal.

This way the sound signal generated by the speaking person located at the mLs microphone (hereafter defined as the first speaking person S1) is reproduced by the left loudspeaker (only). The listener thus perceives the first speaking person as being located at the position of the left loudspeaker L, as for example depicted in FIG. 3.

Figure 3:
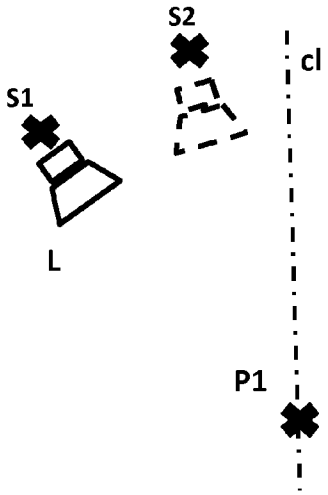
FIG. 3 shows an example of disposition of two loudspeakers for reproduction of a two-channel sound, with the virtual presence of a further sound source obtained with the present invention.

The sound signal generated by the speaking person located at the mL microphone (hereafter defined as the second speaking person S2), however, is reproduced by both the left loudspeaker and the right loudspeaker. As a result, the listener perceives the second speaking person S2 as a so-called phantom source at a position between the left and right loudspeaker. If $\delta$ is substantially smaller than 0.5, the location will be at the left of the center line cl, viewed from the listener, as if the sound from speaking person S2 came from a virtual loudspeaker VL, as shown in FIG. 3.

So, by feeding the right loudspeaker with a portion of the L signal, it is possible to distinguish the two speaking persons located at the mLs and mL microphone, as they are now perceived by the listener at the position of the left loudspeaker and at the right side of the left loudspeaker, respectively.

Likewise in case a recording is made of two speaking persons, the one being positioned close to the mRs microphone and the other positioned close to the mR microphone, a correction is needed to enable a differentiated localization of the two speaking persons during normal stereo reproduction and after down-mixing.

The following formulae for the down-mixing process apply, in which the stereo signal Lo is modified:

$$Lo=L+\alpha\cdot C+\beta\cdot Ls+\delta\cdot R$$

$$Ro=R+\alpha\cdot C+\beta\cdot Rs$$

where $\alpha$, $\beta$ and $\delta$ are constants, like the case above. Also in this case preferably $\delta$ is substantially smaller than 0.5.

Preferably, the Ro signal is also modified in the following way:

$$Ro=\eta\cdot R+\alpha\cdot C+\beta\cdot Rs$$

Where preferably $\eta\leq 1$, more preferably $\eta=(1-\delta)$.

This way the sound signal generated by the speaker located at the mRs microphone (hereafter defined as the first speaker S1) is reproduced by the right loudspeaker (only). The listener thus perceives the first speaker as being located at the position of the right loudspeaker R.

The sound signal generated by the speaker located at the mR microphone (hereafter defined as the second speaker S2), however, is reproduced by both the left loudspeaker and the right loudspeaker. As a result of this, the listener perceives the second speaker S2 to be located at a position between the left and right loudspeaker.

If $\delta$ is substantially smaller than 0.5, the location will be to the right of the center line cl, viewed from the listener, as if the sound from speaker S2 came from a virtual loudspeaker VR (not shown in FIG. 3) positioned between the center line cl and the right loudspeaker R.

So, by feeding the left loudspeaker with a portion of the R signal, it is possible to distinguish the two speaking persons located at the mRs and mR microphone, as they are now perceived by the listener at the position of the right loudspeaker and at the left side of the left loudspeaker, respectively.

From both situations described above, it can be seen that what is maintained is the relative virtual position between the two signal sources, with respect to the original relative position.

Generally we can say that either one of the two-channel audio signals, right Ro or left Lo, is given by a combination of:

- a front (R, L) and rear (Ls, Rs) signal components of the n-channel audio signal of the same side (right or left), and
- a front (L, R) signal component of the n-channel audio signal of the other side (left or right), and
- a term dependent of n, identified in the following as A(n) in the formulae of Ro, and B(n) in the formulae of Lo.

Preferably the other one of the two-channel audio signals, right Ro or left Lo, is generated by a combination of:

- the front (R, L) and rear (Ls, Rs) signal components of the n-channel audio signal of the same side (left or right), said front (R, L) signal component, preferably being multiplied by a factor $\eta$, and
- said term dependent of n.

For n=5, we have A(n)=B(n)=(α·C), therefore a contribution given by the center channel C, and preferably n=(1−δ).

A second embodiment of the method of the invention applies in a situation with an input multi-channel audio signal with n=4 input channels, where the center channel C is lacking, and we have channels L, R, Ls and Rs as defined above.

In this case the above equations (for the case of n=5) still apply for Ro, Lo, without the term (α·C), therefore A(n)=B(n)=0, and preferably η=(1−δ).

A third embodiment of the method of the invention applies in a situation with an input multi-channel audio signal with n=7 input channels.

Figure 4:
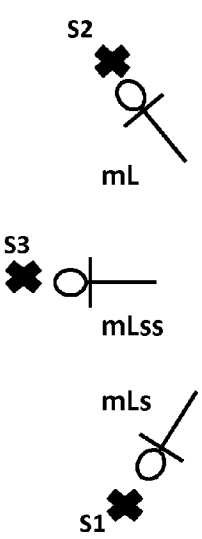
FIGS. 4, 5, and 6 show equivalent situations to respectively FIGS. 1, 2, and 3, with the presence of seven microphones and loudspeakers, and an additional sound source.
Figure 5:
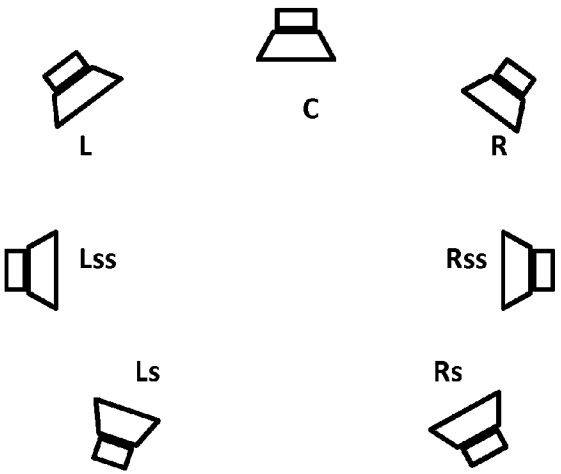

With reference to FIGS. 4 and 5, in this case we still have the five components of the multi-channel audio signal L, R, C, Ls and Rs, respectively front left, front right, center, back left and back right, like for n=5, plus two additional components given by a right side Rss channel and a left side Lss channel.

Like in the previous cases, we have a sound source S1 located at microphone mLs and another sound source S2 located at microphone mL. Now a third sound source (for example a speaker) S3 is located at the left side microphone mLss channel (like in FIG. 4). An equivalent situation applies for the right side, where an additional sound source S1 is located at microphone mRss.

Also in this cases of n=7, the above equations (for the case of n=5) still apply for Ro, Lo. What is changing is the value of A(n) and B(n), in which additional contributions come from the left side Lss or the right side Rss channels.

In fact now we have A(n)=α·C+γ·Rss+ϵ·Lss and B(n)=α·C+γ·Lss+ϵ·Rss. The additional multiplication factors γ and ϵ are preferably smaller than 1. Further, preferably η=(1−δ−ϵ). More preferably δ>ϵ/γ.

Figure 6:
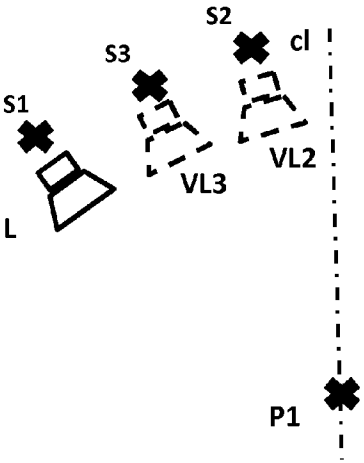

With reference to FIG. 6, in this case of n=7, the sound signal generated by the speaker S1 located at the mRs or mLs microphone is reproduced by the right R or left L loudspeaker (only).

The sound signal generated by the speaker S2 located at the mR or mL microphone is reproduced by both the left loudspeaker and the right loudspeaker. As a result of this, the listener perceives the second speaker S2 to be located at a position between the left L and right R loudspeaker, as from a virtual loudspeaker VL2. Also the sound signal generated by the speaker S3 located at the mRss or mLss microphone is reproduced by both the left loudspeaker and the right loudspeaker, with a different balance between the input signals. The listener perceives the third speaker S3 to be located at a position between the left L and right R loudspeaker, as from a virtual loudspeaker VL3, different with respect to S2. Also in this case it is maintained the relative virtual position between the three signal sources is maintained with respect to the original relative position.

Generally, the presence of the multiplying factors (α, β, δ, η, γ, ϵ) in the various formulae keeps into account the need to control the global level of sound generated by the down-mixed signal, by reducing proportionally the contributions of the original sound components.

As far as some example of apparatus are concerned, for the implementation of the method for conversion of a multi-channel audio signal into a two-channel audio signal of the present invention, the following can apply.

By applying the method of the invention on the signals in a recording and production phase of a multi-channel (surround) recording, it is possible to get the advantage that no modification is needed to the installed base of a consumer stereo equipment, with a stereo amplifier and stereo loudspeaker arrangement. As long as it receives the modified down-mixed stereo signal, a separate localization of sound sources is possible.

In the case of transmission of an original multi-channel (surround) signal, the method of the invention can be implemented in a consumer audio equipment, suitably modified to include means for the implementation of the method.

Preferably additional control signals may be included, during production of the surround signals, to allow the stereo equipment to select which formula to apply and when.

These additional control signals may be included in the metadata that is transmitted together with the multi-channel (surround) signal. For example they can be embedded in one or more of the audio channels, under the masking level of the audio signal, or they can be inserted in an additional channel.

Therefore the down-mixing unit of the consumer audio equipment is adapted to generate the left (Lo) and right (Ro) hand signal components of the stereo audio signal during time intervals defined by occurrences of the additional control signals.

Figure 7:
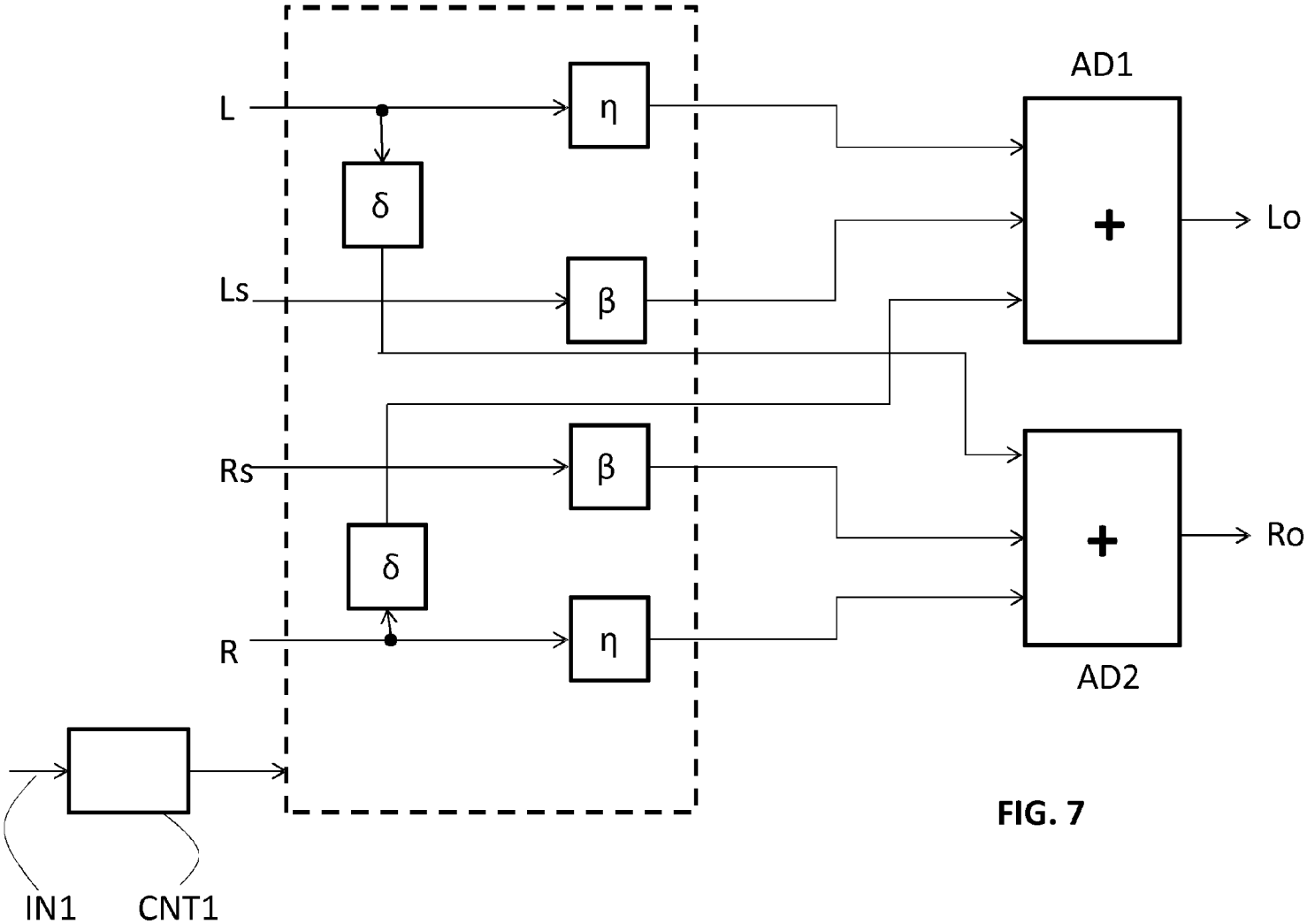
FIGS. 7, 8 and 9 show block diagrams of examples of embodiment of the apparatus according to the invention.
Figure 8:
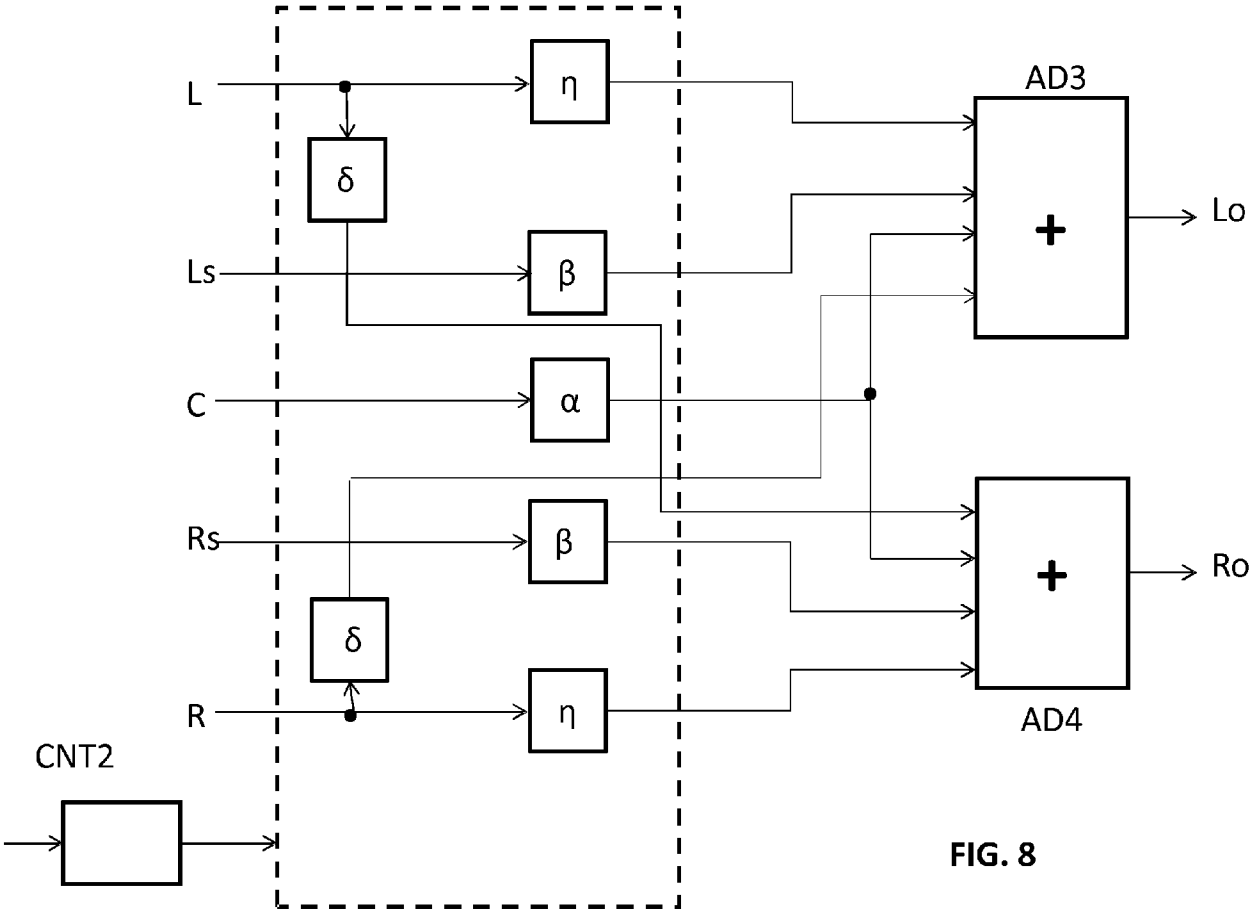
Figure 9:
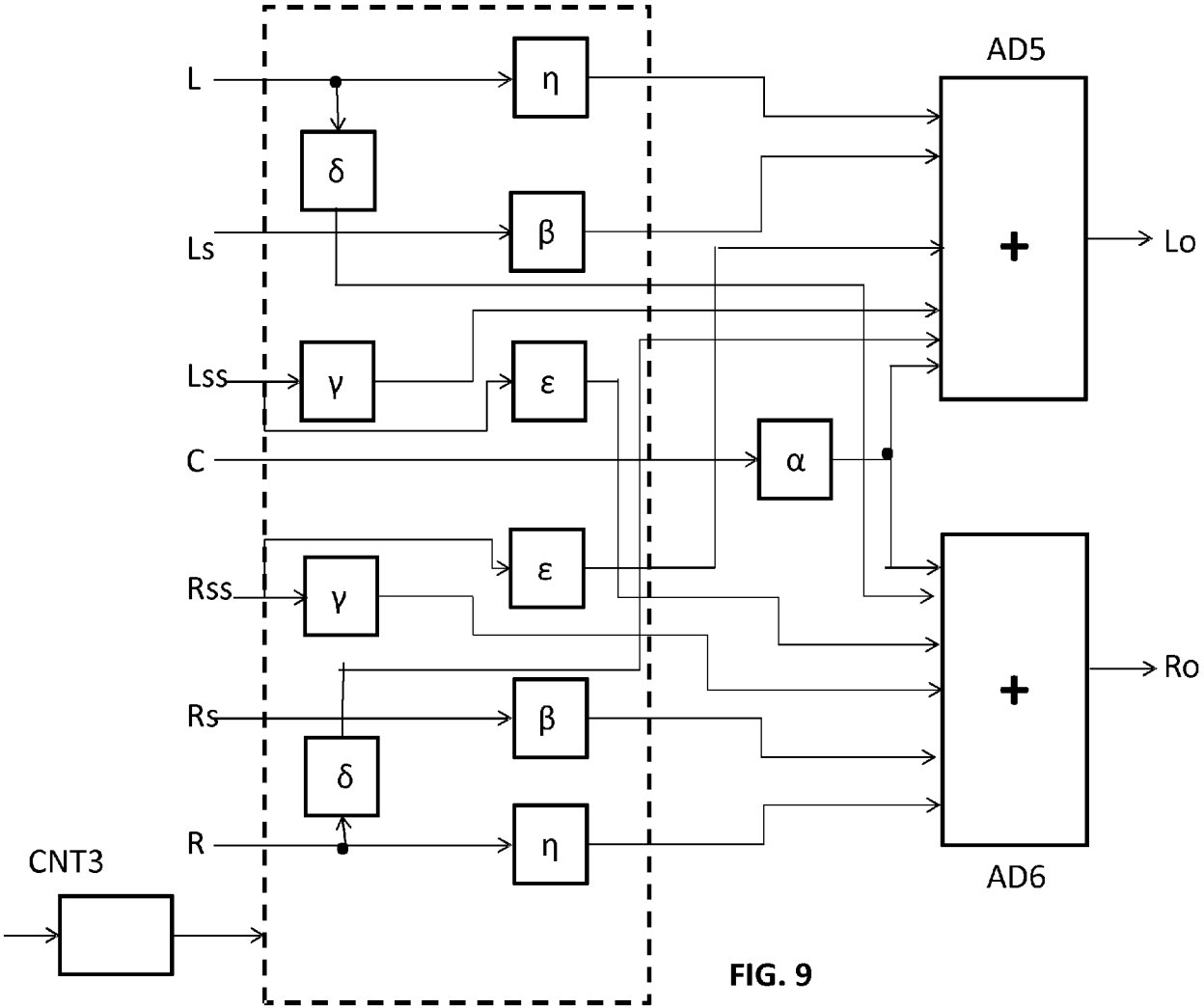

With reference to FIGS. 7, 8 and 9, three block diagrams of examples of embodiment of apparatus according to the invention are described, respectively in the case of n=4, n=5 and n=7.

In FIG. 7, four input signals coming from sound sources L, Ls, Rs, R are applied to circuits multiplying them by factors β, δ, η according to the formulae above for n=4. The respective results are supplied to two summation circuits AD1, AD2 respectively giving as output the stereo down-mixed signals Lo, Ro.

A control circuit CNT1 supplies control signals to enable each of the multiplying factors according to the selection of the specific formula effectively applied, namely depending of the position and/or motion of the sound sources in an audio scene. The control circuit CNT1 receives input signals IN1 for controlling the selection to be applied.

If the conversion from multichannel to two channel is made at the recording and production facility, the control signals can be generated for example by suitably controlling a recording console, according to known criteria.

If the conversion from multichannel to two channel is made at the receiver, the control signals may be generated in the receiver, and the control circuit CNT1 for example suitably demultiplexes or demodulates the additional control signals generated at the recording facility and sent by one of the techniques described above.

In FIG. 8, five input signals coming from sound sources L, Ls, C, Rs, R are applied to circuits multiplying them by factors α, β, δ, η according to the formulae above for n=5. The respective results are supplied to two summation circuits AD3, AD4 respectively giving as output the stereo down-mixed signals Lo, Ro.

The control is made by a control circuit CNT2 in an equivalent way as that described with reference to FIG. 7.

In FIG. 9, seven input signals coming from sound sources L, Ls, Lss, C, Rss, Rs, R are applied to circuits multiplying them by factors α, β, δ, η, γ, ϵ according to the formulae above for n=7. The respective results are supplied to two summation circuits AD5, AD6 respectively giving as output the stereo down-mixed signals Lo, Ro.

The control is made by a control circuit CNT3 in an equivalent way as that described with reference to FIGS. 7 and 8.

The method of the present invention can be advantageously implemented through a program for computer comprising program coding means for the implementation of one or more steps of the method, when this program is running on a computer. Therefore, it is understood that the scope of protection is extended to such a program for computer and in addition to a computer readable means having a recorded message therein, said computer readable means comprising program coding means for the implementation of one or more steps of the method, when this program is run on a computer.

Hereafter follows as a further explanation a value-table disclosing value ranges for the various multiplying parameters described above.

| Parameter | Preferred Range | Preferred Value | Description |
|---|---|---|---|
| δ | [ 0; 0.5] | 0.25 | Portion of the speaker signal of one side (L/R) to be added to the other side (R/L). Creates a new "phantom" sound source located between the two speakers. A value δ = 0.5 places this phantom source in the middle of the two front speakers, a value δ = 0 doesn't create any phantom source. |
| η | [0.5, 1] | 1-δ | Attenuation of the speaker signal of one side to achieve a constant perceived sound level when the this signal is played back using two loudspeakers (L and R, δ > 0) instead of one (L/R, δ = 0) |
| ϵ | [0, 0.5] | 0.125 | Portion of the speaker signal of one side (Lss/Rss) to be added to the other side (Rss/Lss) when n = 7. Creates a new "phantom" sound source located between the two speakers. A value ϵ = 0.5 places this phantom source in the middle of the two front speakers, a value ϵ = 0 doesn't create any phantom source. Preferably ϵ < δ to place this phantom sound source between the real speaker and the other phantom sound source. (This should be equivalent to the formulation in claim 12) |
| γ | [0.5, 1] | 1-ϵ | Attenuation of the speaker signal of one side to achieve a constant perceived sound level when the this signal is played back using two loudspeakers (L and R, ϵ > 0), instead of one (ϵ = 0) |
| α, β | [0, 1] | ~0.7 (−3 dB) | Attenuation of the center signal (or back surround signal) to achieve a constant perceived sound level when this signal is played back using two loudspeakers instead of one. This is a parameter found in typical, state of the art downmix procedures. |

It is however stressed that signal components need not necessarily be combined in a linear way. Also non-linear combinations of the signal components are possible, such as described in WO2011/057922A1, which discloses a combination to obtain a power corrected summation of two signal components.

Many changes, modifications, variations and other uses and applications of the subject invention will become apparent to those skilled in the art after considering the specification and the accompanying drawings which disclose preferred embodiments thereof. All such changes, modifications, variations and other uses and applications which do not depart from the spirit and scope of the invention are deemed to be covered by this invention.

Further implementation details will not be described, as the man skilled in the art is able to carry out the invention starting from the teaching of the above description.

The invention claimed is:

1. An apparatus for converting an n-channel audio signal into a two-channel audio signal, where n≥4 and is an integer, the apparatus comprising:

signal combination means for generating either one of the two-channel audio signals, right or left, by a combination of:

front and rear signal components of the n-channel audio signal of the same side (right or left), and a front signal component of the n-channel audio signal of the other side (left or right), and a term dependent of n, and wherein in the signal combination means further comprises signal multiplication means configured to multiply said front signal component of the n-channel audio signal of the other side by a factor δ<1, and wherein the signal combination means is further configured to generate the other one of the two-channel audio signals, left or right, by a combination of:

the front and rear signal components of the n-channel audio signal of the same side (left or right), said front signal component being multiplied by a factor η, and said term dependent of n, and where η is substantially equal to 1−δ.

2. The apparatus of claim 1, the signal combination means further comprising:

inputs for receiving the n-channel audio signal, a down-mixing unit for converting the n-channel audio signal into a two-channel stereo audio signal, outputs for supplying the two-channel stereo audio signal, wherein the down-mixing unit is configured to generate the right hand channel component (Ro) of the stereo audio signal in the following way:

$$Ro=\eta\cdot R+\beta\cdot Rs+\delta\cdot L+A(n),$$

where R and L are the front right and front left signal components of the four-channel audio signal, Rs is the back right surround signal component of the four-channel audio signal, β and δ are multiplication factors smaller than 1, η is a multiplication factor ≤1, and A(n) is an equation dependent of n.

3. The apparatus of claim 1, the signal combination means further comprising:

inputs for receiving the n-channel audio signal, a down-mixing unit for converting the n-channel audio signal into the two-channel stereo audio signal, outputs for supplying the two-channel stereo audio signal, wherein the down-mixing unit is configured to temporarily generate the left hand channel component (Lo) of the stereo audio signal in the following way:

$$Lo=\eta\cdot L+\beta\cdot Ls+\delta\cdot R+B(n),$$

where R and L are the front right and front left signal components of the four-channel audio signal, Ls is the back left surround signal component of the four-channel audio signal, β and δ are multiplication factors smaller than 1, η is a multiplication factor ≤1, and B(n) is an equation dependent of n.

4. The apparatus as claimed in claim 2, wherein n=4, A(n)=B(n)=0 and η is preferably equal to 1−δ.

5. The apparatus as claimed in claim 2, wherein for n=5, A(n)=B(n)=α·C, where C is the center signal component of the five-channel audio signal, α being a multiplication factor smaller than 1 and η is preferably equal to 1−δ.

6. The apparatus as claimed in claim 2, wherein n=7, A(n)=α·C+γ·Rss+ϵ·Lss and B(n)=α·C+γ·Lss+ϵ·Rss, where C is the center signal component, Lss being the left side signal component and Rss the right side signal component of the 7-channel audio signal, α, γ and ϵ being multiplication factors smaller than 1 and η is preferably equal to 1−δ−ϵ.

7. The apparatus as claimed in claim 6, wherein δ>ϵ/γ.

8. The apparatus as claimed in claim 2, wherein the apparatus is provided with control signal receiving means for receiving a first and a second control signal, the down-mixing unit being configured to generate the left and right hand signal components of the stereo audio signal during time intervals defined by occurrences of the first and second control signal, respectively.

9. The apparatus as claimed in claim 8, wherein the n-channel audio signal further includes an additional channel comprising the first and second control signal, the conversion apparatus further comprising an input for receiving the additional channel and supplying it to said control signal receiving means.

10. A recording apparatus for generating an n-channel audio signal including an additional channel comprising a first and a second control signal, for supply to the conversion apparatus as claimed in claim 8, the recording apparatus comprising inputs for receiving audio signals from at least four audio channels, the four audio channels representing a front left one, a front right one, a back left one and a back right one signal, control signal generator means for generating a first control signal in case a recording is made of two or more audio signals, distributed along the left side of the recorded audio scene, and for generating a second control signal in case a recording is made of two or more audio signals, distributed along the right side of recorded audio scene, means for including the first and second control signal into the additional channel.

11. The apparatus as claimed in claim 1, wherein the factor δ in the range between 0 and 0.5.

12. The apparatus as claimed in claim 1, wherein the factor δ is 0.25.

13. The apparatus as claimed in claim 1, wherein the factor δ in the range between 0 and 0.5.

14. The apparatus as claimed in claim 3, wherein n=4, A(n)=B(n)=0 and η is preferably equal to 1−δ.

15. The apparatus as claimed in claim 3, wherein for n=5, A(n)=B(n)=α·C, where C is the center signal component of the five-channel audio signal, α being a multiplication factor smaller than 1 and η is preferably equal to 1−δ.

16. The apparatus as claimed in claim 3, wherein n=7, A(n)=α·C+γ·Rss+ϵ·Lss and B(n)=α·C+γ·Lss+ϵ·Rss, where C is the center signal component, Lss being the left side signal component and Rss the right side signal component of the 7-channel audio signal, α, γ and ϵ being multiplication factors smaller than 1 and η is preferably equal to 1−δ−ϵ.

* * * * *